US008730122B2

(12) United States Patent
Omuro

(10) Patent No.: US 8,730,122 B2
(45) Date of Patent: May 20, 2014

(54) ANTENNA DEVICE AND COMMUNICATION DEVICE PROVIDED THEREWITH

(75) Inventor: Norihiko Omuro, Tokyo (JP)

(73) Assignee: NEC Corporation, Tokyo (JP)

( * ) Notice: Subject to any disclaimer, the term of this patent is extended or adjusted under 35 U.S.C. 154(b) by 374 days.

(21) Appl. No.: 13/132,484

(22) PCT Filed: Dec. 2, 2009

(86) PCT No.: PCT/JP2009/070250
§ 371 (c)(1),
(2), (4) Date: Jun. 2, 2011

(87) PCT Pub. No.: WO2010/064660
PCT Pub. Date: Jun. 10, 2010

(65) Prior Publication Data

US 2011/0234468 A1 Sep. 29, 2011

(30) Foreign Application Priority Data

Dec. 5, 2008 (JP) ..... 2008-310985

(51) Int. Cl.
*H01Q 19/12* (2006.01)

(52) U.S. Cl.
USPC ..... 343/840

(58) Field of Classification Search
USPC ..... 343/840, 705
See application file for complete search history.

(56) References Cited

U.S. PATENT DOCUMENTS

| | | | |
|---|---|---|---|
| 7,042,407 | B2 | 5/2006 | Syed et al. |
| 7,075,492 | B1 | 7/2006 | Chen et al. |

FOREIGN PATENT DOCUMENTS

| | | | |
|---|---|---|---|
| CN | 1767264 | A | 5/2006 |
| CN | 101283477 | A | 10/2008 |
| DE | 2842298 | A | 5/1980 |
| EP | 1 004 151 | B1 | 12/2006 |
| JP | 60-184310 | A | 12/1965 |
| JP | 54-109436 | A | 8/1979 |
| JP | 57-117810 | A | 7/1982 |
| JP | 61-214802 | A | 9/1986 |
| JP | 62-37413 | A | 3/1987 |
| JP | 1-126611 | A | 8/1989 |
| JP | 8-306440 | A | 11/1996 |
| JP | 2002353723 | A | 12/2002 |
| JP | 2003142918 | A | 5/2003 |
| JP | 2003218630 | A | 7/2003 |
| JP | 2007-208468 | A | 8/2007 |

OTHER PUBLICATIONS

Japanese Office Action for JP Application No. 2010-541338 mailed on Apr. 23, 2013 with English Translation.
Chinese Office Action for CN 200980148168.4 issued on Mar. 22, 2013 with English Translation.

*Primary Examiner* — Seung Lee
(74) *Attorney, Agent, or Firm* — Sughrue Mion, PLLC

(57) ABSTRACT

An antenna device includes a concave-shaped reflecting mirror that reflects radio waves, a primary radiator disposed in the concave mirror and transmitting/receiving radio waves, and an antenna cover attached to an opening face of the reflecting mirror. The antenna cover is secured to the reflecting mirror with a flange part formed on the rim of the antenna cover and fitted to the inner side of a flange part formed on the rim of the reflecting mirror.

4 Claims, 5 Drawing Sheets

ANTENNA DEVICE AND COMMUNICATION DEVICE PROVIDED THEREWITH

This application is the National Phase of PCT/JP2009/070250, filed Dec. 2, 2009, which is based upon and claims the benefit of priority from prior Japanese Patent Application No. 2008-310985, filed Dec. 5, 2008, the entire contents of which are incorporated herein by reference.

TECHNICAL FIELD

The present invention relates to an antenna device and a communication device provided therewith and, more particularly, to an improvement of an antenna device.

BACKGROUND ART

As an antenna device such as a parabolic antenna, there is known one disclosed in, e.g., PTL 1. The antenna device disclosed in PTL 1 has a configuration in which a radome is secured to a reflecting mirror by screws or the like and in which a primary radiator that transmits/receives radio waves is disposed in the reflecting mirror. The radome is a dielectric cover attached to an opening face of the antenna.

Further, as disclosed in PTL 2, there is known an antenna device having a configuration in which a radome is attached so as to protrude from the outer circumference of a parabolic reflecting mirror and in which a radiowave absorber for absorbing radio waves is mounted inside the radome. The antenna device disclosed in PTL 2 absorbs leaky waves using the radiowave absorber to improve radiation directivity.

CITATION LIST

Patent Literature

{PTL 1} JP-A-62-037413
{PTL 2} JP-A-57-117810

SUMMARY OF INVENTION

Technical Problem

In the antenna device of PTL 2, the radiowave absorber is embedded in the radome. This allows the leaky waves to be absorbed/attenuated by means of the radiowave absorber, thereby achieving an improvement in the radiation directivity (especially, wide-angle directivity). However, the configuration of the antenna device of PTL 2 in which the radiowave absorber is embedded in the radome may increase manufacturing cost, which is disadvantageous for mass production in terms of cost.

An object of the present invention is to provide an antenna device having a simple structure and capable of preventing the radiation of unwanted radio waves propagating within the radome.

Solution to Problem

An antenna device according to the present invention includes a concave-shaped reflecting mirror that reflects radio waves, a primary radiator that is disposed in the reflecting mirror and transmits/receives radio waves, and an antenna cover attached to an opening face of the reflecting mirror. The antenna cover is secured to the reflecting mirror with a flange part formed on the rim of the antenna cover fitted to the inner side of a flange portion formed on the rim of the reflecting mirror.

Advantageous Effects of Invention

According to the present invention, there can be provided an antenna device having a simple structure and capable of preventing the radiation of unwanted radio waves propagating within the radome.

DESCRIPTION OF EMBODIMENTS

Exemplary Embodiments for practicing the present invention will be described in detail below with reference to the accompanying drawings.

First Exemplary Embodiment

Figure 1:
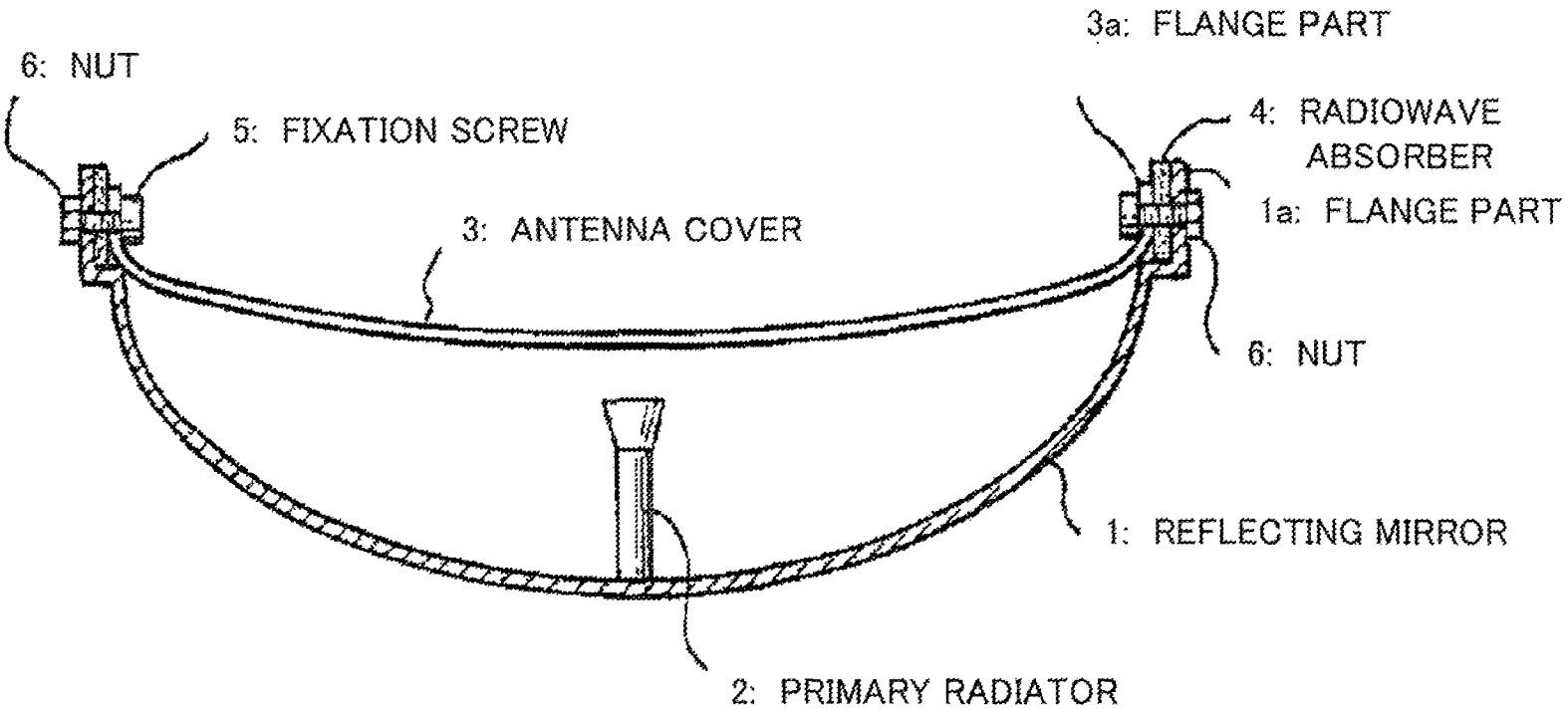
FIG. 1 A cross-sectional view illustrating a first exemplary embodiment of an antenna device according to the present invention.

FIG. 1 is a cross-sectional view illustrating a first exemplary embodiment of the antenna device according to the present invention. In the present invention, an example of a small aperture parabolic antenna for microwave band. In FIG. 1, reference numeral 1 denotes a concave-shaped reflecting mirror shaped like a paraboloid of revolution and reflecting radio waves. A primary radiator 2 that transmits/receives radio waves is disposed in the reflecting mirror 1.

Reference numeral 3 denotes a protective antenna cover (radome) for protecting the primary radiator 2 from weather, which is attached to an opening face of the reflecting mirror 1. As the antenna cover 3, a dielectric body such as a glass fiber-reinforced polyester resin laminated plate is used. The rim of the reflecting mirror 1 protrudes outside by a predetermined distance, and this protruding portion serves as a flange part 1*a* of the reflecting mirror 1 for attachment to the antenna cover 3.

The parabolic antenna of FIG. 1 is an example having a short focal length and a deep reflecting mirror 1. For the above structure, the antenna cover 3 is formed into a concave shape so as to allow the parabolic antenna to resist high wind pressure. The rim of the antenna cover 3 is bent at right angles so as to conform the shape of the flange part 1*a* of the reflecting mirror 1, and this portion serves as a flange part 3*a* of the antenna cover 3 for fixation to the reflecting mirror 1.

A radiowave absorber 4 for absorbing radio waves is disposed between the flange part 3*a* of the antenna cover 3 and flange part 1*a* of the reflecting mirror 1. That is, the antenna cover 3 is secured to the reflecting mirror 1 with the radiowave absorber 4 interposed between the flange part 3*a* of the antenna cover 3 and flange part 1*a* of the reflecting mirror 1.

Specifically, holes for inserting a fixation screw 5 are formed in the radiowave absorber 4 and flange parts 1*a* and 3*a* of the reflecting mirror 1 and antenna cover 3, respectively. The fixation screw 5 is inserted from inside through the holes formed in the flange parts 1*a* and 3*a* and radiowave absorber 4, and the fixation screw 5 is fastened by a nut 6 at the outside of the reflecting mirror 1, whereby the antenna cover 3 and the reflecting mirror 1 are secured to each other with the radiowave absorber 4 interposed therebetween. Alternatively, for example, a configuration may be adopted in which a nutsert is embedded in the reflecting mirror 1 and the fixation screw 5 is used to secure the antenna cover 3 and the reflecting mirror 1 to each other with the radiowave absorber 4 interposed therebetween.

The antenna cover 3 is secured to the reflecting mirror 1 with the flange part 3*a* fitted to the inner side of the flange part 1*a* of the reflecting mirror 1. That is, the end portion of the flange part 3*a* of the antenna cover 3 is positioned inside the reflecting mirror 1 so as to prevent the flange part 3*a* from being protruding outside the reflecting mirror 1. This prevents radio waves propagating within the antenna cover 3 from being radiated from the end portion of the flange part 3*a* of the antenna cover 3.

In the present exemplary embodiment, the radiowave absorber 4 protrudes in height relative to the flange part 3*a* of the antenna cover 3. This configuration is for further ensuring absorption of unwanted radio waves. That is, since the radiowave absorber 4 protrudes in height relative to the flange part 3*a*, even if there is a possibility that the radio waves propagating within the antenna cover 3 may be radiated outside from the end portion of the flange part 3*a*, the radio waves are absorbed by the radiowave absorber 4 more reliably, thereby preventing the radiation of unwanted radio waves reliably.

As described above, when the radiowave absorber 4 is secured between the flange part 3*a* of the antenna cover 3 and flange part 1*a* of the reflecting mirror 1, it is desirable that the radiowave absorber 4 protrudes in height relative to the flange part 3*a* of the antenna cover 3.

With the configuration in which the antenna cover 3 and the reflecting mirror 1 are secured to each other with the radiowave absorber 4 interposed therebetween, it is possible to produce the antenna device more easily and less costly than one having a configuration in which the radiowave absorber 4 is embedded in the radome.

Figure 2:
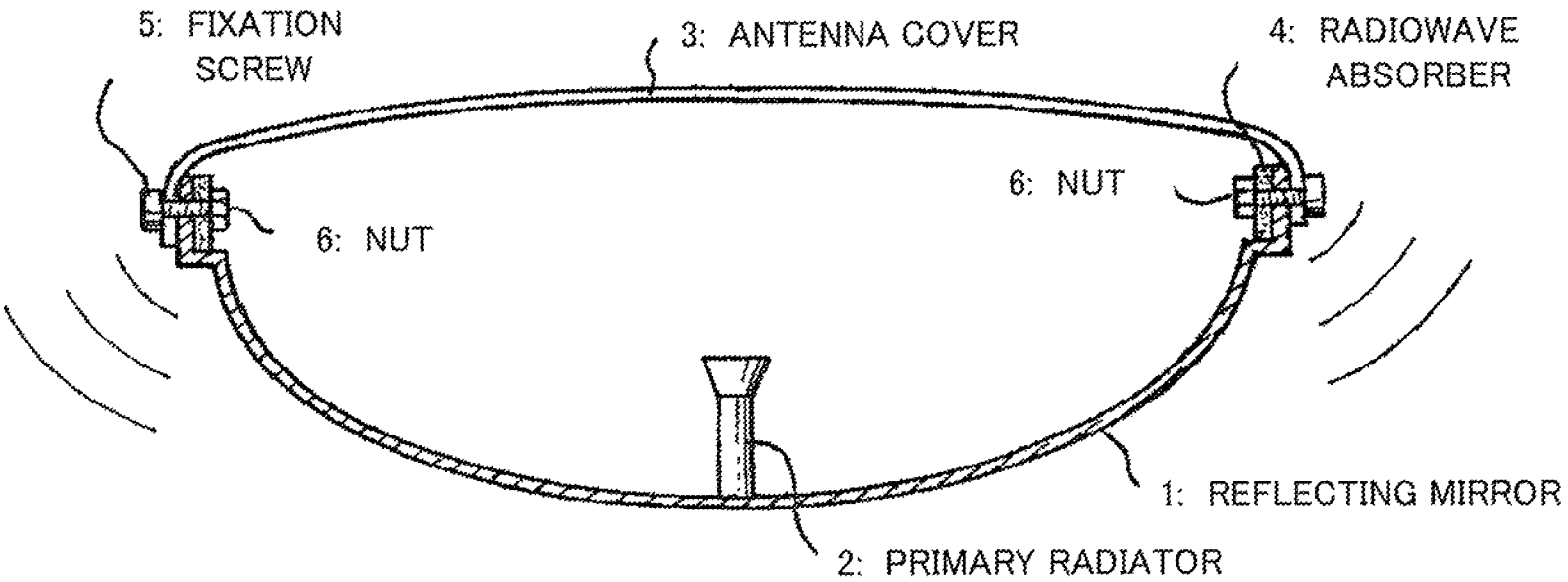
FIG. 2 A cross-sectional view illustrating a comparative example of the present invention.

FIG. 2 is a comparative example of the present invention. FIG. 2 illustrates a configuration in which the flange part of the antenna cover 3 is located outside the reflecting mirror 1 and in which the fixation screw 5 is inserted from outside for fixation of the antenna cover 3. Reference numeral 2 denotes a primary radiator, and reference numeral 4 denotes a radiowave absorber fixed to the inner side of the reflecting mirror 1.

In the configuration of the comparative example, the radio waves propagating within the antenna cover 3 are radiated from the end portion of the flange part of the antenna cover 3 to the back side of the antenna as illustrated in FIG. 2, resulting in degradation of the radiation pattern on the antenna back side.

In the present exemplary embodiment, as described above, the flange part 3*a* of the antenna cover 3 is fitted to the inner side of the flange part 1*a* of the reflecting mirror 1, and further the radiowave absorber 4 is interposed between the flange part 1*a* of the reflecting mirror 1 and flange part 3*a* of the antenna cover 3. This prevents the radiowave propagating within the antenna cover 3 from being radiated from the end portion of the flange part 3*a* to the antenna back, thereby preventing degradation of radiation pattern on the antenna back side.

Although there can be considered other countermeasures for eliminating the radiation of unwanted radio waves, such as application of absorbing coating onto the end portion of the radome and attachment of an absorber, the configuration of the present exemplary embodiment can prevent the radiation of unwanted radio waves reliably, thereby eliminating the need to implement the above countermeasures. Thus, it is possible to reduce cost, which is effective for mass production.

Second Exemplary Embodiment

Figure 3:
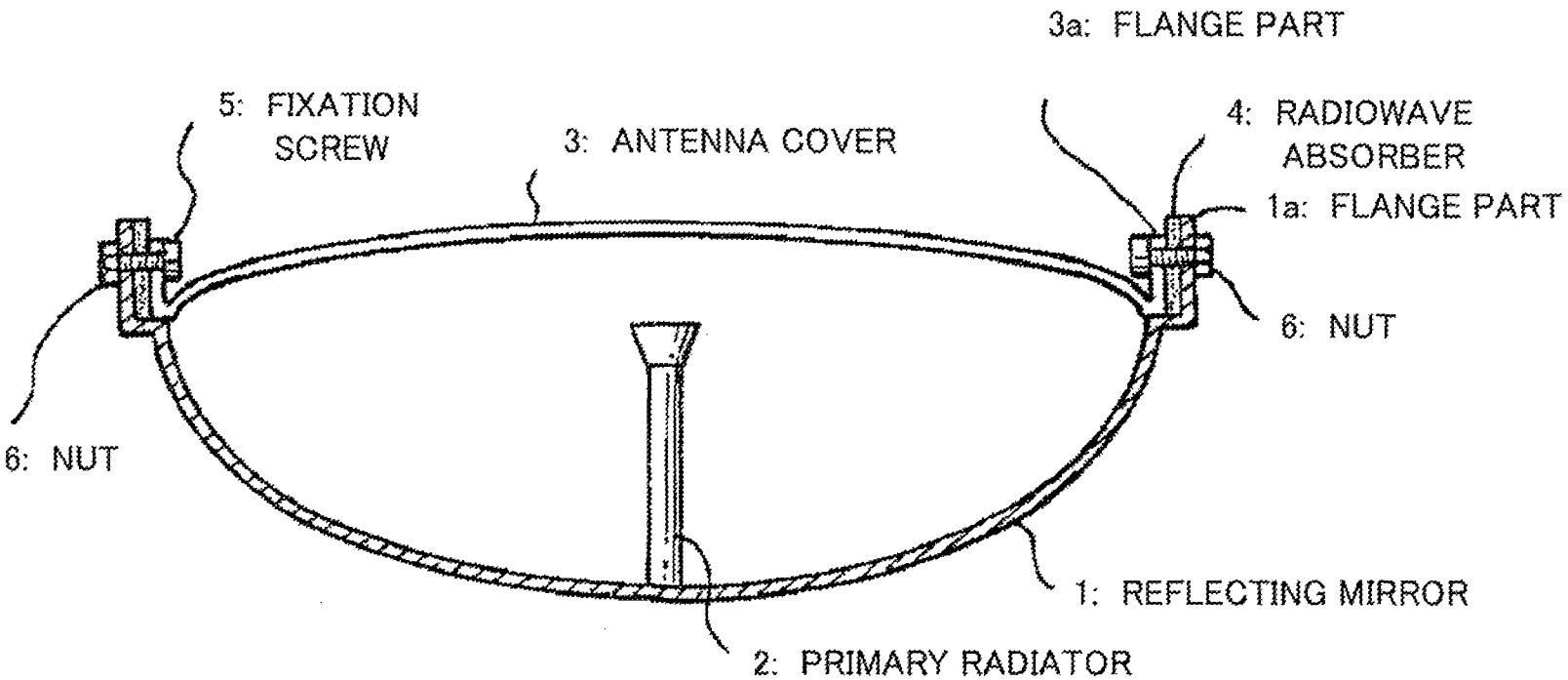
FIG. 3 A cross-sectional view illustrating a second exemplary embodiment of the antenna device according to the present invention.

FIG. 3 is a cross-sectional view illustrating a second exemplary embodiment of the present invention. In FIG. 3, the same reference numerals as those in FIG. 1 denote the same parts as those in FIG. 1. The exemplary embodiment of FIG. 1 is the example of the parabolic antenna having a short focal length and a deep reflecting mirror 1, in which the antenna cover 3 is formed into a concave shape so as to allow the parabolic antenna to resist high wind pressure.

In the present exemplary embodiment, an example of an antenna having a long focal length and a primary radiator 2 whose leading end is positioned at substantially the same height level as the edge of the reflecting mirror 1. In this case, the flange part 3*a* of the antenna cover 3 is formed into the same shape as that of FIG. 1, while the antenna cover 3 is formed into a convex shape. The shape of the reflecting mirror 1 is the same as that of FIG. 1.

As in the case of FIG. 1, in the present exemplary embodiment, the radiowave absorber 4 for absorbing radio waves is disposed between the flange part 3*a* of the antenna cover 3 and flange part 1*a* of the reflecting mirror 1. That is, the antenna cover 3 is secured to the reflecting mirror 1 with the radiowave absorber 4 interposed between the flange part 3*a* of the antenna cover 3 and flange part 1*a* of the reflecting mirror 1. For attachment of the radiowave absorber 4 between the flange part 3*a* of the antenna cover 3 and flange part 1*a* of the reflecting mirror 1, as in the case of FIG. 1, holes for inserting a fixation screw 5 are formed in the radiowave absorber 4 and flange parts 1*a* and 3*a* of the reflecting mirror 1 and antenna cover 3, respectively.

The fixation screw 5 is inserted through the holes formed in the flange parts 1*a* and 3*a* and radiowave absorber 4, and the fixation screw 5 is fastened by the nut 6, whereby the antenna cover 3 and the reflecting mirror 1 are secured to each other with the radiowave absorber 4 interposed therebetween. As a matter of course, as described above, a configuration may be adopted in which a nutsert is embedded in the reflecting mirror 1 and the fixation screw 5 is used to secure the antenna cover 3 and the reflecting mirror 1 to each other with the radiowave absorber 4 interposed therebetween.

Further, as in the case of FIG. 1, the radiowave absorber 4 protrudes in height relative to the flange part 3*a* of the antenna cover 3. Thus, since the radiowave absorber 4 protrudes in height relative to the flange part 3*a*, even if there is a possibility that the radio waves propagating within the antenna cover 3 may be radiated outside from the end portion of the flange part 3*a*, the radio waves are absorbed by the radiowave absorber 4 more reliably, thereby preventing the radiation of unwanted radio waves reliably.

Further, as in the case of FIG. 1, the antenna cover 3 and the reflecting mirror 1 are secured to each other with the radiowave absorber 4 interposed therebetween, so that it is possible to produce the antenna device more easily and less costly than one having a configuration in which the radiowave absorber 4 is embedded in the radome.

Further, the flange part 3*a* of the antenna cover 3 is fitted to the inner side of the reflecting mirror 1, and further the radiowave absorber 4 is interposed between the flange part 1*a* of the reflecting mirror 1 and flange part 3*a* of the antenna cover 3. This prevents a disadvantage which occurs in the comparative example of FIG. 2. That is, the radiowave propagating within the antenna cover 3 is prevented from being radiated from the end portion of the flange part 3*a* to the antenna back, thereby preventing degradation of radiation pattern on the antenna back side.

As described above, although there can be considered other countermeasures for eliminating the radiation of unwanted radio waves, such as application of absorbing coating onto the end portion of the radome and attachment of an absorber, the configuration of the present exemplary embodiment can prevent the radiation of unwanted radio waves reliably, thereby eliminating the need to implement the above countermeasures. Thus, it is possible to reduce cost, which is effective for mass production.

As described above, according to the first and second exemplary embodiments, the radiowave absorber is disposed between the flange part of the antenna cover and flange part of the reflecting mirror, so that it is possible to absorb unwanted radio waves propagating within the antenna cover and radiated from the end portion of the antenna cover without employing a configuration in which the radiowave absorber is embedded in the antenna cover. In particular, with the configuration in which the radiowave absorber protrudes in height relative to the flange part of the antenna cover, the radio waves can be absorbed by the radiowave absorber more reliably, thereby preventing the radiation of unwanted radio waves reliably.

Further, with the simple configuration in which the radiowave absorber is disposed between the antenna cover and the reflecting mirror, it is possible to produce the antenna device less costly than one having a configuration in which the radiowave absorber is embedded in the radome. Thus, it is advantageous for mass production in terms of cost.

Third Exemplary Embodiment

Figure 4:
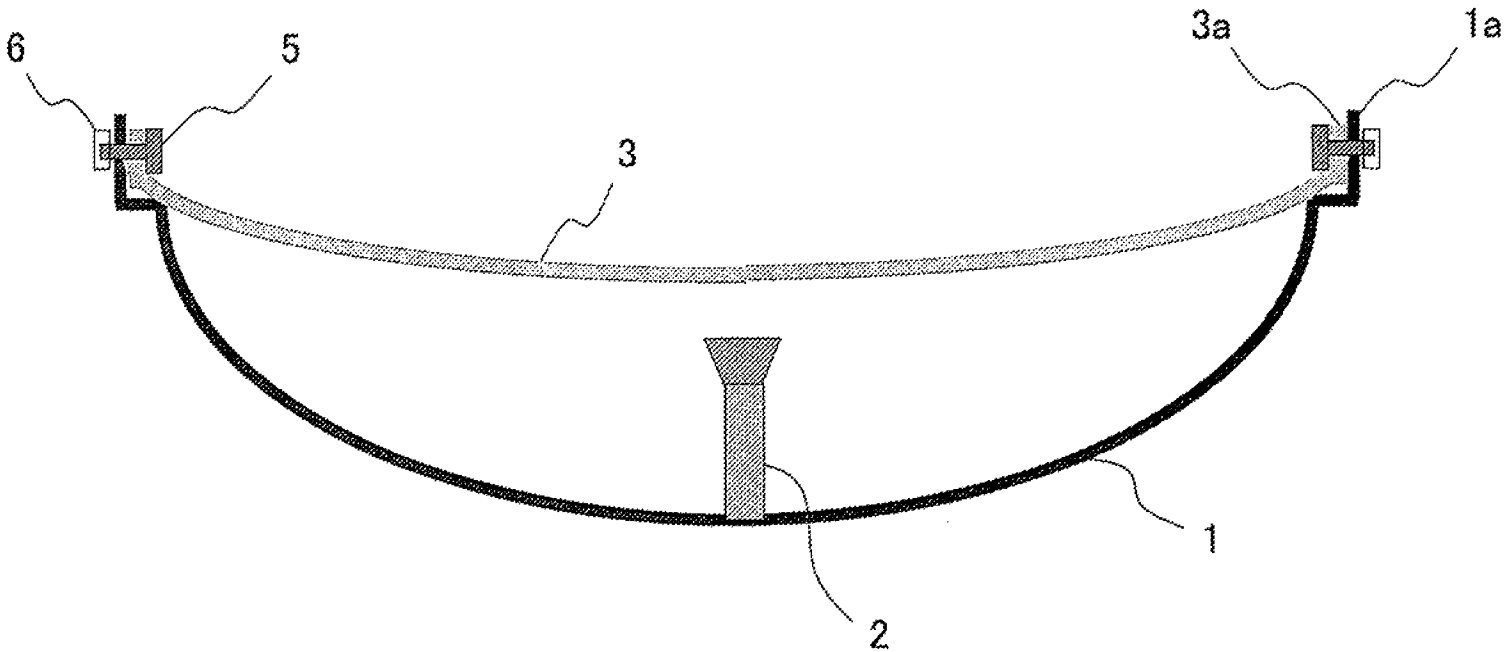
FIG. 4 A cross-sectional view illustrating a third exemplary embodiment of the antenna device according to the present invention.

FIG. 4 illustrates a third exemplary embodiment of the antenna device according to the present invention. Although a case using the radiowave absorber 4 has been described in the first exemplary embodiment, the present invention is not limited to this, but, as in the case of the third exemplary embodiment of FIG. 4, a configuration may be possible in which the radiowave absorber 4 is not used. The same reference numerals as those in the first exemplary embodiment denote the same parts as those in the first exemplary embodiment, and the descriptions thereof will be simplified or omitted.

Also in this case, as in the case of the first exemplary embodiment, the concave-shaped antenna cover 3 is secured to the reflecting mirror 1 with the flange part 3*a* formed on the rim of the antenna cover 3 fitted to the inner side of the flange part 1*a* formed on the rim of the reflecting mirror 1. That is, the end portion of the flange part 3*a* of the antenna cover 3 is positioned inside the reflecting mirror 1 so as to prevent the flange part 3*a* from being protruding outside the reflecting mirror 1. This prevents radio waves propagating within the antenna cover 3 from being radiated from the end portion of the flange part 3*a* of the antenna cover 3.

Thus, as in the case of the first exemplary embodiment, the flange part 3*a* of the antenna cover 3 is positioned inside the flange part 1*a* of the reflecting mirror 1, so that the radiowave propagating within the antenna cover 3 is prevented from being radiated from the end portion of the flange part 3*a* to the antenna back, thereby preventing degradation of radiation pattern on the antenna back side.

Fourth Exemplary Embodiment

Figure 5:
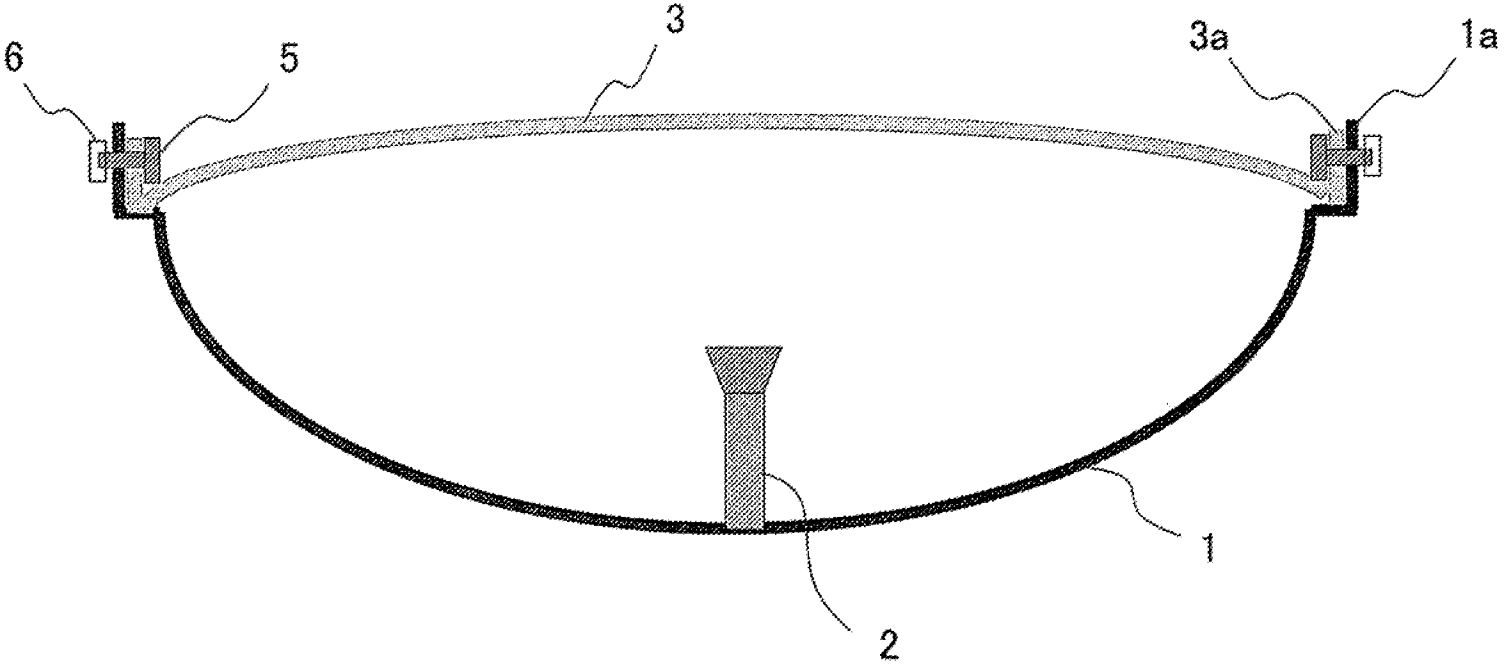
FIG. 5 A cross-sectional view illustrating a fourth exemplary embodiment of the antenna device according to the present invention.

FIG. 5 illustrates a fourth exemplary embodiment of the antenna device according to the present invention. Although a case using the radiowave absorber 4 has been described in the second exemplary embodiment, the present invention is not limited to this, but, as in the case of the fourth exemplary embodiment of FIG. 5, a configuration may be possible in which the radiowave absorber 4 is not used. The same reference numerals as those in the first and second exemplary embodiments denote the same parts as those in the first and second exemplary embodiments, and the descriptions thereof will be simplified or omitted.

Also in this case, the convex-shaped antenna cover 3 is secured to the reflecting mirror 1 with the flange part 3*a* formed on the rim of the antenna cover 3 fitted to the inner side of the flange part 1*a* formed on the rim of the reflecting mirror 1. That is, the end portion of the flange part 3*a* of the antenna cover 3 is positioned inside the reflecting mirror 1 so as to prevent the flange part 3*a* from being protruding outside the reflecting mirror 1. This prevents radio waves propagating within the antenna cover 3 from being radiated from the end portion of the flange part 3*a* of the antenna cover 3.

Thus, as in the case of the second exemplary embodiment, the flange part 3*a* of the convex-shaped antenna cover 3 is positioned inside the reflecting mirror 1, so that it is possible to prevent a disadvantage which occurs in the comparative example of FIG. 2. That is, the radiowave propagating within the antenna cover 3 is prevented from being radiated from the end portion of the flange part 3*a* to the antenna back, thereby preventing degradation of radiation pattern on the antenna back side.

Although only the antenna device has been described in the above first to fourth exemplary embodiments, the present invention is applicable to a communication device provided with the antenna device.

Although the present invention has been described using the exemplary embodiments, the present invention is not limited to the above exemplary embodiments. Further, various modifications that can be appreciated by those skilled in the art may be made to the configuration or details of the present invention within the scope of the present invention.

INDUSTRIAL APPLICABILITY

The present invention is suitably applied to an antenna device and a communication device provided therewith.

REFERENCE SIGNS LIST

1: Reflecting mirror
1*a*: Flange part of reflecting mirror
2: Primary radiator
3: Antenna cover
3*a*: Flange part of antenna cover
4: Radiowave absorber
5: Fixation screw
6: Nut

The invention claimed is:

1. An antenna device comprising a concave-shaped reflecting mirror that reflects radio waves, a primary radiator that is disposed in the reflecting mirror and transmits/receives radio waves, and an antenna cover attached to an opening face of the reflecting mirror, wherein the antenna cover is secured to the reflecting mirror with a flange formed on a rim of the antenna cover and a flange formed on a rim of the reflecting mirror, the flange of the antenna cover being fitted to an inner side of the flange of the reflecting mirror, a radiowave absorber is disposed between the flange of the antenna cover and the flange of the reflecting mirror, and the radiowave absorber protrudes in height relative to an end portion of the flange of the antenna cover.

2. The antenna device according to claim 1, wherein the antenna cover is formed into a concave shape.

3. The antenna device according to claim 1, wherein the antenna cover is formed into a convex shape.

4. A communication device comprising a transmitter, a receiver and the antenna device as claimed in claim 1.

* * * * *